US006005374A

United States Patent [19]

Tasdighi

[11] Patent Number: 6,005,374

[45] Date of Patent: Dec. 21, 1999

[54] LOW COST PROGRAMMABLE LOW DROPOUT REGULATOR

[75] Inventor: Ali Tasdighi, San Jose, Calif.

[73] Assignee: TelCom Semiconductor, Inc., Mountain View, Calif.

[21] Appl. No.: 08/832,580

[22] Filed: Apr. 2, 1997

[51] Int. Cl.[6] ..... G05F 1/44

[52] U.S. Cl. ..... 323/273; 323/313

[58] Field of Search ..... 323/273, 282, 323/313, 314, 316

[56] References Cited

U.S. PATENT DOCUMENTS

| | | | |
|---|---|---|---|
| 4,325,018 | 4/1982 | Schade, Jr. | 323/313 |
| 4,399,399 | 8/1983 | Joseph | 323/315 |
| 4,446,419 | 5/1984 | Van De Plassche et al. | 323/316 |
| 4,978,868 | 12/1990 | Giordano et al. | 323/316 |
| 5,568,045 | 10/1996 | Koazechi | 323/314 |

*Primary Examiner*—Adolf Berhane

*Attorney, Agent, or Firm*—Skjerven, Morrill, Macpherson, Franklin & Friel LLP; Edward C. Kwok

[57] ABSTRACT

A programmable low dropout regulator includes an operational amplifier which is used both to provide a bandgap voltage and to drive an output load. In one embodiment implemented in an integrated circuit, external resistors are provided by the user to achieve a user-selected regulated voltage. In that embodiment, an input pin allows the user to select also internal resistors which provide a predetermined regulated voltage.

4 Claims, 2 Drawing Sheets

LOW COST PROGRAMMABLE LOW DROPOUT REGULATOR

BACKGROUND OF THE INVENTION

1. Field of the Invention

The present invention relates to voltage regulators, and in particular relates to temperature independent voltage regulators.

2. Discussion of the Related Art

The base-to-emitter voltage ($V_{be}$) of a conducting transistor bipolar is known to be highly stable, having a temperature coefficient of −2 mV per °C. The stability of this voltage results from a physical property of the silicon PN junction—the energy gap ("bandgap") in silicon between the top of the valence band and the bottom of the conduction band. Thus, if the bandgap voltage is matched with a voltage which temperature coefficient is approximately 2 mV per °C., a substantially temperature independent voltage regulator can be achieved. Such a voltage regulator is known in the art as a "bandgap" regulator.

SUMMARY OF THE INVENTION

The present invention provides a low drop-out regulator. The low drop-out regulator, which provides a regulated output voltage at an output terminal, includes (a) a differential amplifier having a first input terminal, a second input terminal, and an output terminal coupled to provide the output voltage; (b) a first bipolar transistor having a collector terminal coupled to a reference voltage, a base terminal coupled to the output terminal of the differential amplifier, and an emitter terminal coupled to the first input terminal of the differential amplifier; (c) a second bipolar transistor being sized a predetermined multiple of the first bipolar transistor, the second bipolar transistor having a collector terminal coupled to the reference voltage, a base terminal coupled to the base terminal of the first bipolar transistor, and an emitter terminal; (d) a first resistor coupling the emitter terminal of the first bipolar transistor to a ground voltage; and (e) a voltage divider including a second resistor and a third resistor, the second resistor coupling the emitter terminal of the second bipolar transistor to the second input terminal of the differential amplifier, and the third resistor coupling the second input terminal of the differential amplifier to the ground voltage.

In one embodiment of the present invention, the low drop-out regulator provides the output voltage through a second voltage divider which includes a fourth resistor and a fifth resistor, the fourth resistor coupling the output terminal of the differential amplifier to the output terminal of the low drop-out regulator and the base terminals of the first and second bipolar transistors, the fifth resistor coupling the output terminal of the differential amplifier to the ground voltage.

In another embodiment, the low drop-out regulator provides the output voltage by an output circuit which includes (i) an MOS transistor having a gate terminal, a source terminal and a drain terminal, the drain terminal being coupled to the output terminal of the differential amplifier, the source terminal being coupled to the reference voltage; and (ii) a resistor coupling the base terminals of the first and second bipolar transistors and the output terminal of the low drop-out regulator to the ground voltage.

In another embodiment of the present invention, the low drop-out regulator provides an output voltage at the output terminal of the differential amplifier, the low drop-out regulator further includes: (a) a fourth resistor coupling the output terminal of the differential amplifier to the base terminals of the first and second bipolar transistors; and (b) a fifth resistor coupling the base terminals of the differential amplifier to the ground voltage.

In yet another embodiment of the present invention, the low drop-out regulator receives an input signal at an input terminal. The low drop-out regulator includes: (a) a switch circuit coupled to receive the input signal; and (b) a voltage divider including a fourth resistor and a fifth resistor; wherein when the input signal is in a first state, the switch circuit couples (i) the fourth resistor between the output terminal of the low drop-out regulator and the base terminals of the first and second bipolar transistors, and (ii) the fifth resistor between the base terminals of the first and second bipolar transistors and the ground voltage.

Another variation to the low drop-out regulator allows a user to provide a sixth resistor and seventh resistor, the sixth resistor being coupled between the output terminal of the low drop-out regulator and the input terminal of the low drop-out regulator, and the seventh resistor coupling the input terminal of the low drop-out regulator to the ground voltage; wherein when the input signal is in a second state, the switch circuit couples the terminals of the first and second bipolar transistors and the input terminal of the differential amplifier.

In the present invention, the same operational amplifier or differential amplifier both provides the bandgap voltage and drives the output voltage. Thus, the present invention uses fewer transistors, and hence less silicon real estate, than bandgap regulators of the prior art. Accordingly, the manufacturing cost of the regulators of the present invention can be much reduced over the prior art because, for the same silicon die size, longer channel transistors can be used. Such transistors can be produced under a very cost effective manufacturing process, such as a process under a metal gate CMOS technology.

The present invention is better understood upon consideration of the detailed description below and the accompanying drawings.

DETAILED DESCRIPTION OF THE PREFERRED EMBODIMENTS

Figure 1A:
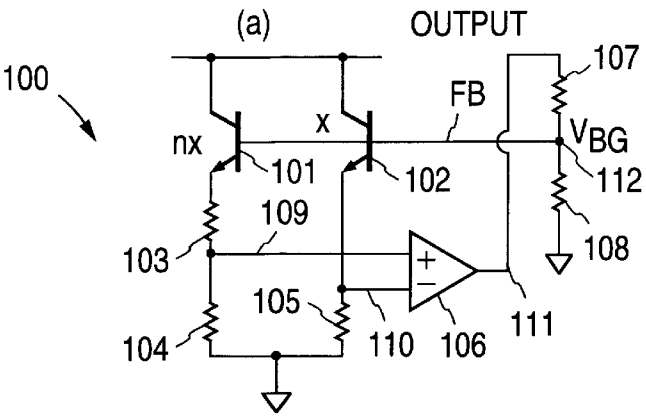
FIG. 1*a* shows circuit 100, according to one embodiment of the present invention.

The present invention provides a voltage regulator circuit which provides a temperature-independent output voltage. The general principles of the present invention are illustrated with reference to FIGS. 1*a*–1*d*, which show respectively circuits 100, 140, 160 and 180 in various embodiments of the present invention. In the following description, like elements are provided like reference numerals to facilitate comparison between circuit elements in these figures.

As shown in FIG. 1*a*, NPN bipolar transistors 101 and 102 are both biased at their base terminals by a voltage at terminal 112. The voltage at terminal 112 is the output voltage of differential amplifier 106 divided proportionally by the voltage divider formed by resistors 107 and 108. The output voltage of operational or differential amplifier 106 at terminal 112 controls the collector currents in NPN bipolar transistors 101 and 102, and therefore controls the voltages at terminals 109 and 110 through the voltage divider formed by resistors 103 and 104, and resistor 105 respectively. Terminals 109 and 110 are the differential input terminals to amplifier 106. Since differential amplifier 106 has very high gain, typically exceeding 1000, the voltages at terminals 109 and 110 are substantially equal.

In circuit 100, NPN transistor 101 is selected to be N times larger than NPN transistor 102. If resistors 104 and 105 are chosen to have the same resistance, the currents in resistors 104 and 105 are constrained by amplifier 106 to be equal, so that the voltage difference in the base-to-emitter voltages of NPN transistors 101 and 102 are dropped across resistor 103. Accordingly, the following equation holds:

$$V_{be,102}-V_{be,101}=IR_1$$

where $V_{be,101}$, $V_{be,102}$ are respectively the $V_{be}$'s of NPN transistors 101 and 102, I is the collector current in each of NPN transistors 101 and 102, and $R_1$ is the resistance of resistor 103. It is also known that the difference in $V_{be}$'s between NPN transistors 101 and 102 are related by:

$$V_{be,102}-V_{be,101}=V_T ln\ N$$

where N is the ratio of the width of NPN transistor 101 to the width of NPN transistor 102, and $V_T$ is the "thermal voltage". Thus, the current in resistor 103 is given by:

$$I=\frac{V_T}{R_1}\ln\ N$$

Consequently, the voltage $V_{bg}$ at the base terminal 112 of NPN transistor 101 is given by:

$$V_{bg}=V_{be,101}+\frac{(R_2+R_1)}{R1}V_T\ln\ N$$

where $R_2$ is the resistance of resistor 104. Since $V_T$ is known to have a positive temperature coefficient of 0.086 mV per °C., the second term in the above equation can be made, by appropriately choosing the values of $R_1$, $R_2$ and N, to match the thermal coefficient of the bandgap voltage in first term, which is −2 mV per °C., so that the voltage $V_{bg}$ at terminal 112 is substantially independent of temperature.

Figure 1B:
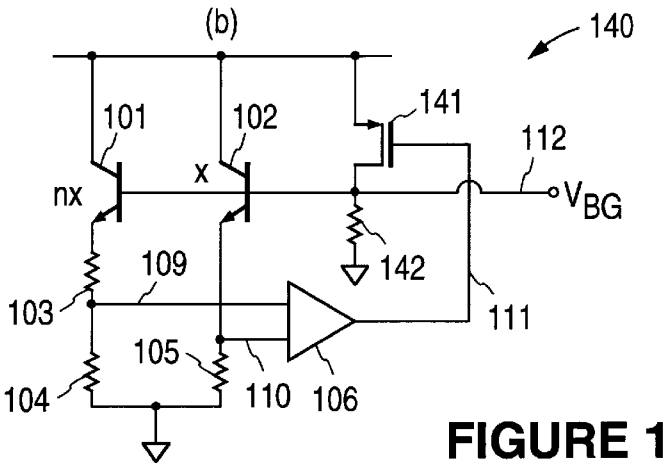
FIG. 1*b* shows circuit 140, according to one embodiment of the present invention.

FIG. 1*b* shows circuit 140, according to one embodiment of the present invention. In circuit 140, the output voltage of differential amplifier 106 drives the gate terminal of PMOS transistor 141, which controls the current in resistor 142. In circuit 140, $V_{bg}$ is taken as the voltage across resistor 142.

Figure 1C:
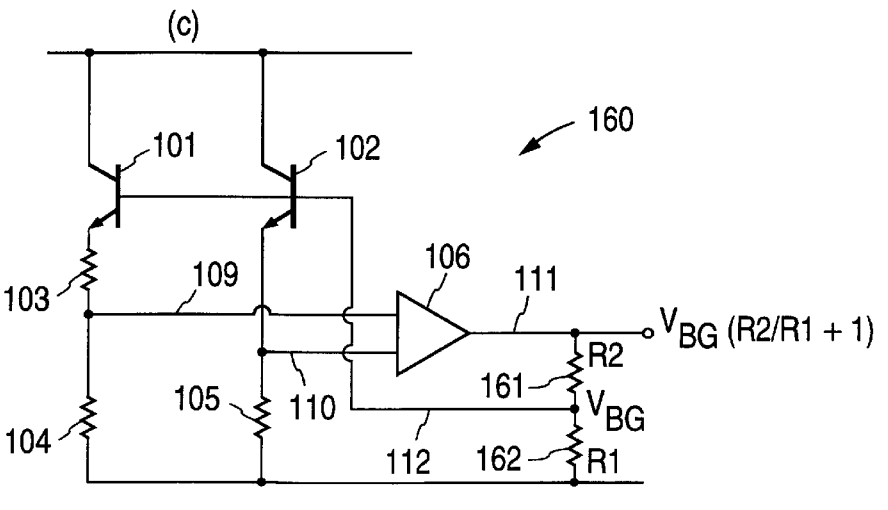
FIG. 1*c* shows circuit 160, according to one embodiment of the present invention.

FIG. 1*c* shows circuit 160, according to one embodiment of the present invention. In circuit 160, the output voltage of differential amplifier 106 provides amplified output voltage $V_{out}$, which is related to voltage $V_{bg}$ at terminal 112 by the equation:

$$V_{out}=V_{bg}\left(\frac{R_4}{R_5}+1\right)$$

where $R_4$ and $R_5$ are the resistances of resistors 161 and 162, respectively.

Figure 1D:
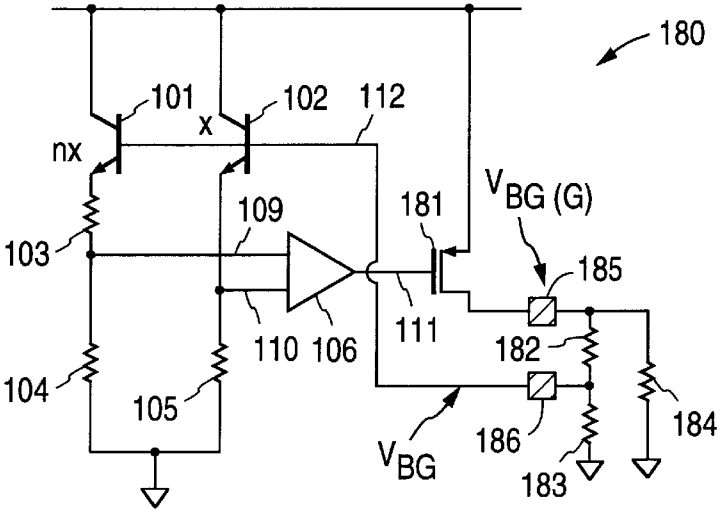
FIG. 1*d* shows circuit 180, according to one embodiment of the present invention.

FIG. 1*d* shows circuit 180, according to one embodiment of the present invention. Circuit 180 is implemented as an integrated circuit with pins 185 and 186. The output voltage of differential amplifier 106 drives the gate terminal of PMOS transistor 181, which supplies currents to resistors 182, 183, and 184. If resistors 182 and 183 are chosen to be much larger than resistor 184 (which represent the output load), resistor 182 and 183 sets the output voltage level in the manner shown above with respect to circuit 160.

Figure 2A:
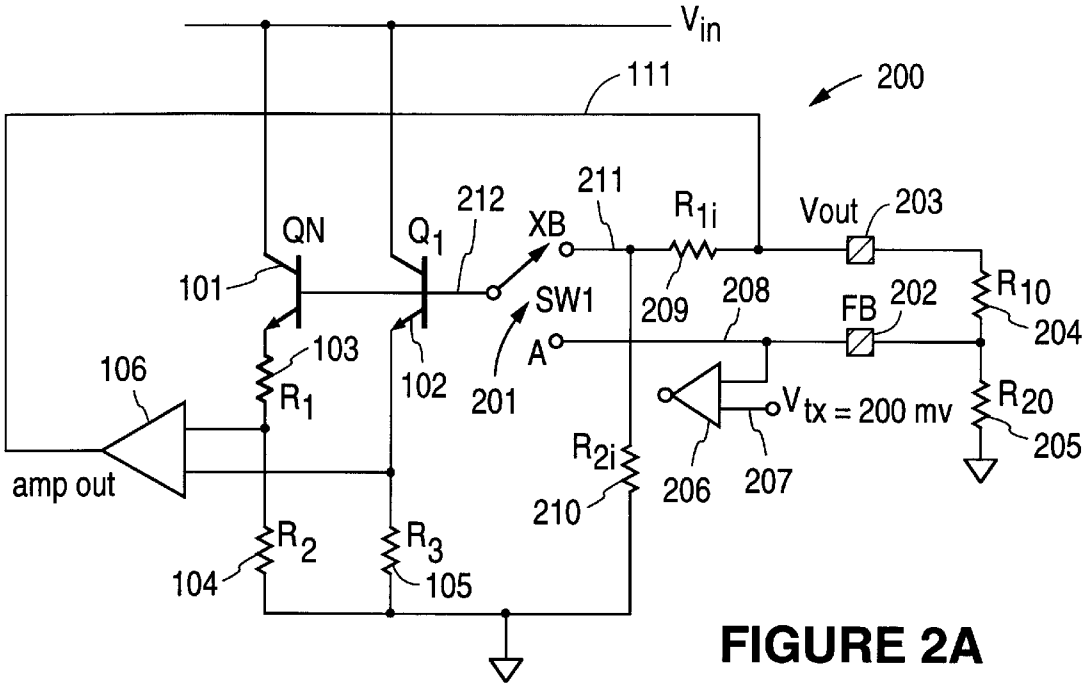
FIG. 2*a* shows circuit 200, according to one embodiment of the present invention.
Figure 2C:
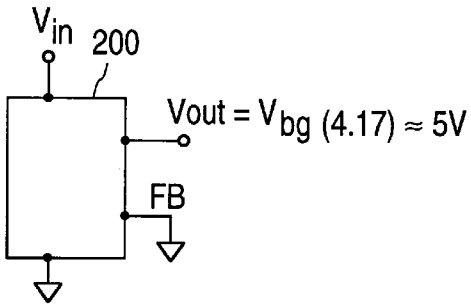
FIG. 2*c* shows circuit 200 in one configuration, in which internal resistors 209 and 210 provide an amplified output voltage $V_{out}$.
Figure 2B:
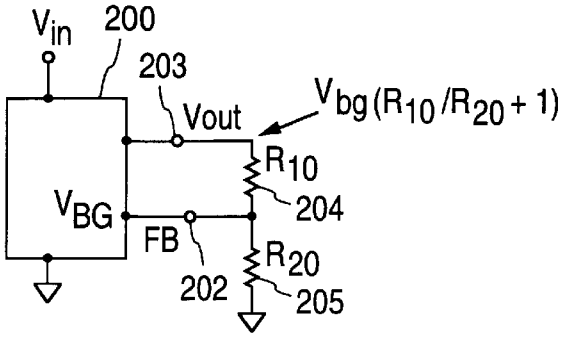
FIG. 2*b* shows circuit 200 in one configuration, in which external resistors 204 and 205 provide an amplified output voltage $V_{out}$.

FIG. 2*a* shows circuit 200, which is another integrated circuit implementation of one embodiment of the present invention. In circuit 200, pin 203 provides an output voltage $V_{out}$ and pin 204 receives an input voltage $V_{fb}$. If $V_{fb}$ is greater than a predetermined voltage $V_{tx}$ (about 200 mV for this embodiment) at internal terminal 207, a comparator circuit 206 causes a switch 201 to form a conductive path between terminal 212 and terminal 208 ("A" position). Terminal 212 is the base terminal of NPN transistors 101 and 102, and terminal 208 is coupled to pin 202. This configuration, i.e. $V_{fb}$ greater than $V_{tx}$, is achieved by providing external resistors 204 and 205 across pins 203 and 202, and between pin 202 and ground, as shown in FIG. 2*b*. As in circuit 160 of FIG. 1*c*, the output voltage $V_{out}$ of circuit 200 in this configuration is determined by the ratio of the resistances $R_{10}$ and $R_{20}$ of resistors 204 and 205: By selecting different resistance values for resistors 204 and 205, a voltage regulator for a wide range of voltages above $V_{bg}$ (~1.2 volts) can be achieved.

Alternatively, if pin 203 is grounded, as shown in FIG. 2*a*, switch 201 forms a conductive path between terminals 212 and 211 ("XB" position), internal resistors 209 and 210 provide an amplified output voltage $V_{out}$ given by:

$$V_{out}=V_{bg}\left(\frac{R_{1i}}{R_{2i}}+1\right)$$

where $R_{1i}$ and $R_{2i}$ are the resistances of resistors 209 and 210, respectively. Since $V_{bg}$ is about 1.2 V, if the ratio $$\frac{R_{1i}}{R_{2i}}$$

is selected to be about 3.17, the resulting $V_{out}$ is approximately 5 volts. Since resistors 209 and 210 are internal to the integrated circuit, they can be very accurately matched. Further, if NPN transistors 101 and 102 are designed to have a collector current in the order of 1 microamp, so that the base current is in is the order of 1 nanoamp, given that the gain of each of transistors 101 and 102 typically exceeds 1000. Consequently, the series resistance of switch 201 is inconsequential to circuit 200's performance.

Since the present invention uses the same operational amplifier (i.e. differential amplifier 106) to derive both the bandgap voltage $V_{bg}$ and to drive the output voltage, the present invention uses fewer transistors, and hence less silicon real estate, than bandgap regulators of the prior art. Accordingly, the manufacturing cost of the regulators of the present invention can be much reduced over the prior art because, for the same silicon die size, longer channel transistors can be used. Such transistors can be produced under a very cost effective manufacturing process, such as a process under a metal gate technology.

The above detailed description is provided to illustrate the specific embodiments of the present invention and is not intended to be limiting. Numerous variations and modifications within the scope of the present invention are possible. The present invention is defined by the appended claims.

I claim:

1. A low drop-out regulator for providing an output voltage at an output terminal, comprising:

a differential amplifier having a first input terminal, a second input terminal, and an output terminal coupled to provide said output voltage;

a first bipolar transistor having a collector terminal coupled to a reference voltage, a base terminal coupled to said output terminal of said differential amplifier, and an emitter terminal coupled to said first input terminal of said differential amplifier;

a second bipolar transistor being sized a predetermined multiple of said first bipolar transistor, said second bipolar transistor having a collector terminal coupled to said reference voltage, a base terminal coupled to said base terminal of said first bipolar transistor, and an emitter terminal;

a first resistor coupling said emitter terminal of said first bipolar transistor to a ground voltage; and a voltage divider including a second resistor and a third resistor, said second resistor coupling said emitter terminal of said second bipolar transistor to said second input terminal of said differential amplifier, and said third resistor coupling said second input terminal of said differential amplifier to said ground voltage;

wherein said output voltage is provided by an output circuit comprising:

an MOS transistor having a gate terminal, a source terminal and a drain terminal, said drain terminal being coupled to said output terminal of said differential amplifier, said source terminal being coupled to said reference voltage; and a resistor coupling said base terminals of said first and second bipolar transistors and said output terminal of said low drop-out regulator to said ground voltage.

2. A low drop-out regulator for providing an output voltage at an output terminal, comprising:

a differential amplifier having a first input terminal, a second input terminal, and an output terminal coupled to provide said output voltage;

a first bipolar transistor having a collector terminal coupled to a reference voltage, a base terminal coupled to said output terminal of said differential amplifier, and an emitter terminal coupled to said first input terminal of said differential amplifier;

a second bipolar transistor being sized a predetermined multiple of said first bipolar transistor, said second bipolar transistor having a collector terminal coupled to said reference voltage, a base terminal coupled to said base terminal of said first bipolar transistor, and an emitter terminal;

a first resistor coupling said emitter terminal of said first bipolar transistor to a ground voltage; and a voltage divider including a second resistor and a third resistor, said second resistor coupling said emitter terminal of said second bipolar transistor to said second input terminal of said differential amplifier, and said third resistor coupling said second input terminal of said differential amplifier to said ground voltage;

wherein said output terminal of said differential amplifier providing said output voltage of said low drop-out regulator, said low drop-out regulator further comprising:

a fourth resistor coupling said output terminal of said differential amplifier to said base terminals of said first and second bipolar transistors; and a fifth resistor coupling said base terminals of said differential amplifier to said ground voltage.

3. A low drop-out regulator for providing an output voltage at an output terminal, comprising:

a differential amplifier having a first input terminal, a second input terminal, and an output terminal coupled to provide said output voltage;

a first bipolar transistor having a collector terminal coupled to a reference voltage, a base terminal coupled to said output terminal of said differential amplifier, and an emitter terminal coupled to said first input terminal of said differential amplifier;

a second bipolar transistor being sized a predetermined multiple of said first bipolar transistor, said second bipolar transistor having a collector terminal coupled to said reference voltage, a base terminal coupled to said base terminal of said first bipolar transistor, and an emitter terminal;

a first resistor coupling said emitter terminal of said first bipolar transistor to a ground voltage; and a voltage divider including a second resistor and a third resistor, said second resistor coupling said emitter terminal of said second bipolar transistor to said second input terminal of said differential amplifier, and said third resistor coupling said second input terminal of said differential amplifier to said ground voltage;

wherein said low drop-out regulator receives an input signal at an input terminal, said low drop-out regulator further comprising:

a switch circuit coupled to receive said input signal; and a voltage divider comprising a fourth resistor and a fifth resistor; wherein when said input signal is in a first state, said switch circuit couples (i) said fourth resistor to said output terminal of said low drop-out regulator and said base terminals of said first and second bipolar transistors, and (ii) said fifth resistor to said base terminals of said first and second bipolar transistors and said ground voltage.

4. A low drop-out regulator as in claim 3, said low drop-out regulator allowing a user to provide a sixth resistor and seventh resistor, said sixth resistor being coupled between said output terminal of said low drop-out regulator and said input terminal of said low drop-out regulator, and said seventh resistor coupling said input terminal of said low drop-out regulator to said ground voltage; wherein when said input signal is in a second state, said switch circuit couples said base terminals of said first and second bipolar transistors and said input terminal of said differential amplifier.

* * * * *